US007483646B2

(12) United States Patent
Ueno et al.

(10) Patent No.: US 7,483,646 B2
(45) Date of Patent: Jan. 27, 2009

(54) DEVELOPER CONTAINER, PROCESS CARTRIDGE, IMAGE FORMING APPARATUS AND MANUFACTURING METHOD FOR DEVELOPER CONTAINER

(75) Inventors: Takahito Ueno, Mishima (JP); Masaki Kakitani, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 448 days.

(21) Appl. No.: 11/415,169

(22) Filed: May 2, 2006

(65) Prior Publication Data

US 2006/0251445 A1 Nov. 9, 2006

(30) Foreign Application Priority Data

May 9, 2005 (JP) ..... 2005-136318
Apr. 17, 2006 (JP) ..... 2006-113697

(51) Int. Cl.
*G03G 15/08* (2006.01)

(52) U.S. Cl. ..... 399/102; 399/103; 399/105; 399/106

(58) Field of Classification Search ..... 399/102–103, 399/105–106
See application file for complete search history.

(56) References Cited

U.S. PATENT DOCUMENTS

| | | | | |
|---|---|---|---|---|
| 5,809,374 | A * | 9/1998 | Tsuda et al. | 399/102 |
| 6,195,515 | B1 * | 2/2001 | Fujita et al. | 399/103 |
| 6,385,416 | B1 | 5/2002 | Horikawa et al. | 399/111 |
| 6,608,980 | B2 | 8/2003 | Murayama et al. | 399/111 |
| 6,654,575 | B2 * | 11/2003 | Miura et al. | 399/102 |
| 6,823,153 | B2 | 11/2004 | Ueno et al. | 399/103 |
| 6,834,175 | B2 | 12/2004 | Murayama et al. | 399/256 |
| 6,954,600 | B2 | 10/2005 | Fujita et al. | 399/90 |
| 6,970,668 | B2 | 11/2005 | Ueno et al. | 399/109 |
| 6,978,099 | B2 | 12/2005 | Ueno et al. | 399/103 |
| 7,062,200 | B2 | 6/2006 | Ueno et al. | 399/111 |
| 7,092,658 | B2 | 8/2006 | Yasumoto et al. | 399/167 |
| 7,139,502 | B2 | 11/2006 | Koishi et al. | 399/93 |
| 7,158,749 | B2 | 1/2007 | Ueno et al. | 399/351 |
| 7,174,122 | B2 | 2/2007 | Fujita et al. | 399/258 |
| 2003/0099480 | A1 * | 5/2003 | Nishimura et al. | 399/102 |
| 2005/0135842 | A1 * | 6/2005 | Murakami et al. | 399/262 |
| 2006/0051133 | A1 | 3/2006 | Koishi et al. | 399/167 |
| 2006/0067725 | A1 | 3/2006 | Miyabe et al. | 399/90 |
| 2006/0269318 | A1 | 11/2006 | Ueno et al. | 399/106 |
| 2007/0098453 | A1 | 5/2007 | Fujita et al. | 399/258 |

FOREIGN PATENT DOCUMENTS

| | | |
|---|---|---|
| JP | 2004-37637 A | 2/2004 |
| JP | 2005-43539 A | 2/2005 |

* cited by examiner

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

A developer container for an image forming apparatus, said developer container including a rotatable member; a container body for containing a developer; a sealing member, provided in the container body, for preventing leakage of the developer out of the container body; a sheet, provided in the container body, for contacting the rotatable member to guide the developer into the container body; a gap provided between the container body and the sealing member and covered by the sheet; a communication hole provided in the container body in fluid communication with the gap; packing material filled in the gap through the communication hole for preventing leakage of the developer through the gap.

13 Claims, 14 Drawing Sheets

DEVELOPER CONTAINER, PROCESS CARTRIDGE, IMAGE FORMING APPARATUS AND MANUFACTURING METHOD FOR DEVELOPER CONTAINER

FIELD OF THE INVENTION AND RELATED ART

The present invention relates to a developer container, a cartridge, a process cartridge, an image forming apparatus, and a method for manufacturing a developer container.

An image forming apparatus, such as a printer which employs an electrophotographic process, forms a latent image by uniformly charging a photosensitive drum as an image bearing member, and selectively exposing numerous points of the peripheral surface of the photosensitive drum. Then, the image forming apparatus develops the latent image into a visible image (image formed of toner, which hereafter will be referred to as toner image), with the use of developer, and transfers the toner image onto recording medium. Further, the image forming apparatus applies heat and pressure to the transferred toner image, whereby the toner image is fixed to the recording medium, concluding the image recording process of the image forming apparatus.

An apparatus such as the above described one must be supplied with toner, and also, the various processing means of the apparatus must be maintained. Thus, a process cartridge has been put to practical use as the means for making easier the operation for supplying the apparatus with toner, and the apparatus maintenance. Here, a process cartridge means a cartridge (frame) in which a photosensitive drum, and at least one processing means among a charging means, a developing means, a cleaning means, etc., are integrally disposed, and which is removably mountable.

A cleaning apparatus of the process cartridge such as the above described one has a cleaning apparatus has a photosensitive drum, a charge roller (charging means) for charging the photosensitive drum, a cleaning member for collecting the developer remaining the photosensitive drum by scraping the photosensitive drum, and a cleaning apparatus frame for supporting the preceding components.

The cleaning apparatus prevents the toner stored in the cleaning apparatus frame from leaking from the frame. In order to prevent the leak, the cleaning apparatus is provided with a pair of sealing members (end seals), which are located at the lengthwise ends of the cleaning member, and a sealing sheet. When the cleaning apparatus is assembled, gaps are created between the end seals and the surfaces of the cleaning apparatus frame, because of the errors in the shape of the end seal, the errors in the step for pasting the end seals, and/or the like. Thus, in order to plug these gaps between the end seals and cleaning apparatus frame, filler/sealer (injectable filler) is injected into the gaps (Japanese Laid-open Patent Application 2004-37637).

The above described structural arrangement is employed to prevent the toner in the cleaning apparatus frame from leaking out through the gaps between the surfaces of the frame and the end seals.

However, the above described structural arrangement, which is based on the prior art, is problematic in that if the amount by which filler/sealer is filled into the gaps between the end seals and cleaning apparatus frame to plug them is small, the gaps fail to be completely plugged.

On the other hand, if the amount is large, the filler/sealer pushes up the sealing sheet, creating thereby gaps between the sealing sheet and end seals.

If gaps such as the ones described above occur to the frame for storing developer, it is possible for the developer to leak through the gaps.

In the past, in order to prevent the occurrence of the above described problems, the amount by which the filler/sealer is injected during the process for assembling a process cartridge has been strictly controlled.

SUMMARY OF THE INVENTION

The present invention was made in consideration of the above described problems. Thus, the primary object of the present invention is to prevent developer from leaking, without strictly controlling the amount of the filler to be injected.

Another object of the present invention is to prevent the filler from oozing out.

According to an aspect of the present invention, there is provided a developer container for an image forming apparatus, said developer container comprising a rotatable member; a container body for containing a developer; a sealing member, provided in said container body, for preventing leakage of the developer out of said container body; a sheet, provided in said container body, for contacting said rotatable member to guide the developer into said container body; a gap provided between said container body and said sealing member and covered by said sheet; a communication hole provided in said container body in fluid communication with said gap; packing material filled in said gap through said communication hole for preventing leakage of the developer through said gap.

According to another aspect of the present invention, there is provided a process cartridge detachably mountable to a main assembly of an image forming apparatus, said process cartridge comprising an image bearing member; a cleaning member for removing a developer deposited on said image bearing member; a container body for containing the developer removed by said cleaning member; a sealing member, provided in said container body, for preventing the developer from leaking out of said container body; a sheet, provided in said container body and for contacting said image bearing member to guide the developer removed by said cleaning member into said container body; a gap provided between said container body and said sealing member and covered by said sheet; a communication hole provided in said container body in fluid communication with said gap; and packing material filled in said gap through said communication hole for preventing leakage of the developer through said gap out of said container body.

According to a further aspect of the present invention, there is provided a method for a developer container for use with an image forming apparatus, comprising i) a container body preparing step for preparing a container body for containing a developer, said container body having a communication hole; ii) a sealing member mounting step of mounting a sealing member on said container body so as to provide a gap between said container body and itself, said gap being in fluid communication with said communication hole; a sheet mounting step of mounting a sheet on said container body so as to cover said gap; and a packing material injecting step of injecting packing material into said gap through said communication hole.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. However, the measurements, materials, shapes, and relative positioning of the structural components described in the following preferred embodiments of the present invention are to be modified in accordance with the structure and various conditions of the apparatus to which the present invention is applied. In other words, the following preferred embodiments are not intended to limit the scope of the present invention.

The present invention relates to a developer container, a process cartridge, an image forming apparatus employing a process cartridge, and a method for manufacturing a developer container.

Here, as an example of an image forming apparatus, an electrophotographic image forming apparatus is mentioned. An electrophotographic image forming apparatus is an electrophotographic apparatus which forms an image on recording medium (recording paper, OHP sheet, etc.) with the use of an electrophotographic image forming method. As examples of an electrophotographic image forming apparatus, an electrophotographic copying machine, an electrophotographic printing machine (for example, laser printer, LED printer, etc.), a facsimile apparatus, a wordprocessor, etc., for example, can be included.

A developer container means a container which has an image bearing member in the form of a rotational member, or a development roller, and which is employed by an image forming apparatus. Further, a process cartridge means a cartridge in which an image bearing member, and at least a cleaning member as a processing means, are integrally disposed, and which is removably mountable in the main assembly of an image forming apparatus. A process cartridge may be provided with either a charging means or a developing means, as a processing means, in addition to the cleaning member. The process cartridge in the preferred embodiments which will be described below is provided with a cleaning member, a charging means, and a developing means, which are integrally disposed in the process cartridge, in addition to an electrophotographic photosensitive drum as an image bearing member.

[General Structure of Multicolor Image Forming Apparatus]

Figure 1:
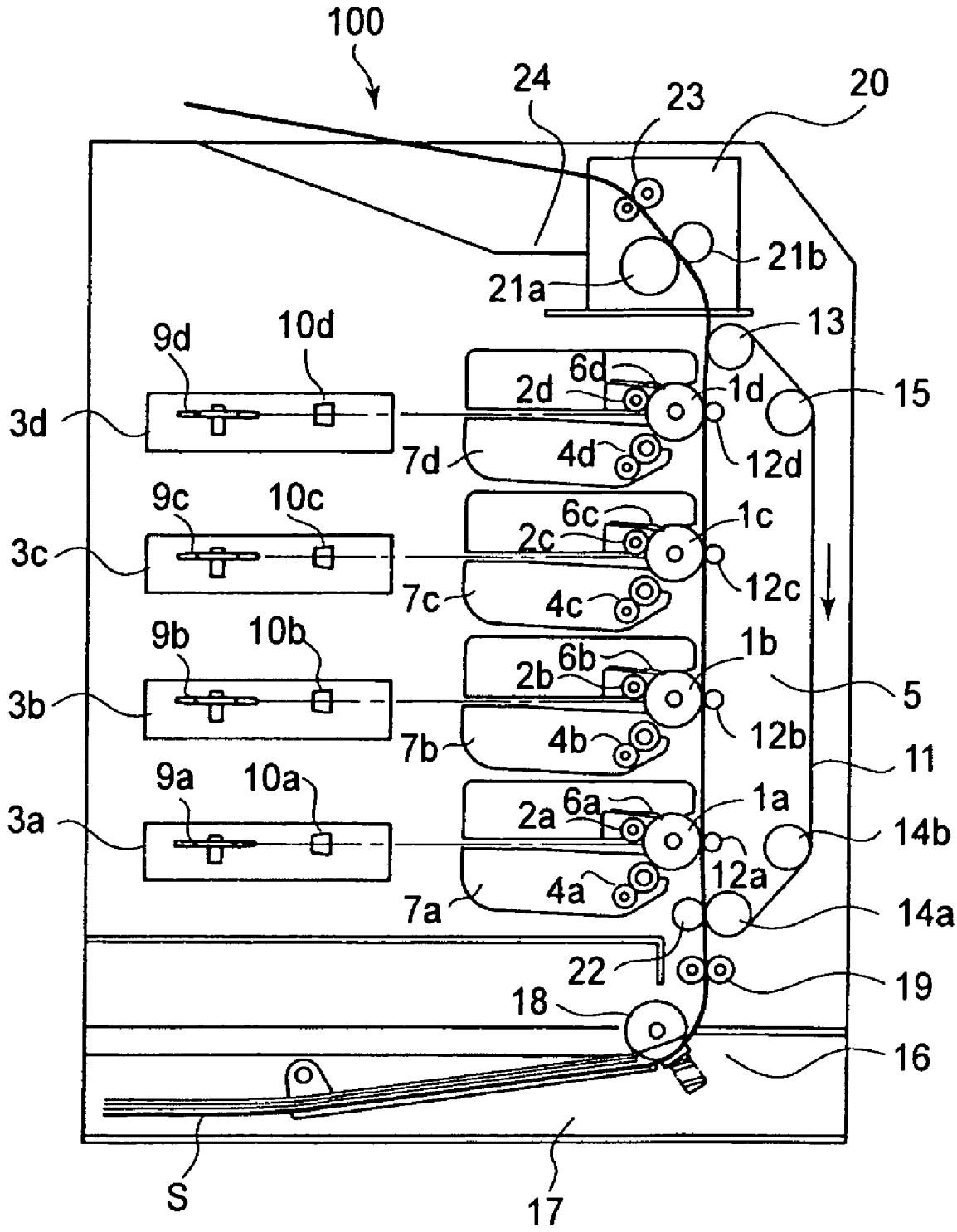
FIG. 1 is a schematic sectional view of the image forming apparatus in one of the preferred embodiments of the present invention.

First, referring to FIG. 1, the general structure of the image forming apparatus in one of the preferred embodiments of the present invention will be roughly described. FIG. 1 is a vertical sectional view of a full-color laser beam printer 100 (which hereafter may be referred to as image forming apparatus main assembly) as an example of a multicolor image forming apparatus, showing the general structure thereof.

The image forming apparatus main assembly 100 in FIG. 1 is provided with four electrophotographic photosensitive drums 1 (1*a*, 1*b*, 1*c*, and 1*d*) (which hereinafter will be referred to as photosensitive drums) as image bearing members, which are vertically aligned in parallel.

Each photosensitive drum 1 is rotationally driven by a driving means (unshown) in the counterclockwise direction of the drawing. In the adjacencies of the peripheral surface of the photosensitive drum 1, a charging means 2 (2*a*, 2*b*, 2*c*, and 2*d*), a scanner unit 3 (3*a*, 3*b*, 3*c*, and 3*d*), a developing apparatus 4 (4*a*, 4*b*, 4*c*, and 4*d*), a cleaning apparatus 6 (6*a*, 6*b*, 6*c*, and 6*d*), and an electrostatic transferring apparatus 5 are disposed, listed from the upstream side in terms of the rotational direction of the photosensitive drum 1. The charging means 2 uniformly charges the peripheral surface of the photosensitive drum 1. The scanner unit 3 forms an electrostatic latent image on the photosensitive drum 1 by projecting a beam of laser light, while modulating it with image formation information, onto the photosensitive drum 1. The development unit 4 develops the electrostatic latent image into a developer image, that is, an image formed of developer, by adhering developer (which hereafter may be referred to as toner) to the electrostatic latent image. The electrostatic transferring apparatus 5 transfers the toner image on the photosensitive drum 1 onto a recording medium S. The cleaning apparatus 6 removes the toner remaining on the peripheral surface of the photosensitive drum 1 after the transfer of the toner image.

Here, the photosensitive drum 1, charging means 2, developing apparatus 4, and cleaning apparatus 6 are integrally disposed in a cartridge, making up a process cartridge 7.

Next, the abovementioned components will be described in detail, starting from the photosensitive drum 1 as a rotational member.

The photosensitive drum 1 is made up of an aluminum cylinder, for example, and a layer of photoconductor (OPC) coated on the peripheral surface of the aluminum cylinder. It is rotatably supported by a pair of supporting members, by the lengthwise ends. To one of the lengthwise ends of the photosensitive drum 1, driving force is transmitted from a motor (unshown), rotationally driving the photosensitive drum 1 in the counterclockwise direction.

As for the charging means 2, a charging means of the contact type may be employed. The charging means 2 is in the form of an electrically conductive roller. The peripheral surface of the photosensitive drum 1 is uniformly charged by applying charge bias to this roller while the roller is kept in contact with the peripheral surface of the photosensitive drum 1. In this embodiment, one of the reversal development methods is employed. Thus, the peripheral surface of the photosensitive drum 1 is charged to the negative polarity.

As for the structure and function of the scanner unit 3, a beam of image formation light is projected, while being modulated with video signals, from the laser diode (unshown) onto a polygon mirror 9 (9*a*, 9*b*, 9*c*, and 9*d*) which is being rotated at a high speed. The beam of image forming light is reflected by the polygon mirror 9, and focused on the peripheral surface of the charged peripheral surface of the photosensitive drum 1 through a focal lens 10, selectively exposing the numerous points of the charged peripheral surface of the photosensitive drum 1. As a result, an electrostatic latent image is formed.

The developing apparatuses 4 (4*a*, 4*b*, 4*c*, and 4*d*) have developer containers 46 (46*a*, 46*b*, 46*c*, or 46*d*), which contain yellow, magenta, cyan, and black toners, respectively. Each developer container 46 is provided with a toner conveyance mechanism 42 and a toner supply roller 43, which are disposed in the developer container 46. The toner in the developer container 46 is sent to the toner supply roller 43 by the toner conveyance mechanism 42. The toner supply roller 43 rotates in the clockwise direction indicated by an arrow mark in the drawing. The toner supply roller 43 supplies the development roller 40 with the toner, and also, strips the toner remaining on the development roller 40 after the development of the latent image on the photosensitive drum 1.

As the developer is supplied to the development roller 40 as a rotational member, which is rotating in the clockwise direction indicated by the arrow mark in the drawing, it is coated on the peripheral surface of the development roller 40 by a development blade 44 kept pressed upon the peripheral surface of the development roller 40. While the toner is coated on the peripheral surface of the development roller 40 by the development blade 44, it is also given electric charge by the blade 44.

Then, development bias is applied to the development roller 40, which opposes the photosensitive drum 1 on which an electrostatic latent image is borne. As a result, the latent image on the peripheral surface of the photosensitive drum 1 is developed.

The electrostatic transferring apparatus 5 is provided with an electrostatic belt 11 (electrostatic conveyer belt), which is disposed so that it opposes all of the photosensitive drums 1*a*, 1*b*, 1*c*, and 1*d* and circularly moves in contact with all of the photosensitive drums 1. As the material for the electrostatic transfer belt 11, resin film, multilayer film made up of a substrate layer formed of rubber and a resin layer formed on the substrate layer, or the like is used. The transfer belt 11 is stretched around a driver roller 13, follower rollers 14*a* and 14*b*, and a tension roller 15. The transfer belt 11 circularly moves so that the recording medium S is electrostatically adhered to the outward surface of the left portion of the transfer belt 11, in terms of the loop which the transfer belt 11 forms, and also, so that the recording medium S is placed in contact with the abovementioned photosensitive drums 1. As the transfer belt 11 moves as described above, the recording medium S is conveyed by the transfer belt 11 to each of the transfer areas, in which the toner image on the photosensitive drum 1 is transferred onto the recording medium S.

The electrostatic transferring apparatus 5 is also provided with transfer rollers 12 (12*a*, 12*b*, 12*c*, and 12*d*), which are disposed in parallel, in the areas in which they oppose the four photosensitive drums 1*a*, 1*b*, 1*c*, and 1*d*, respectively. During a transfer operation, positive electric charge is applied to these transfer rollers 12, whereby the positive electric charge is applied to the recording medium S through the transfer belt 11, generating an electric field. As a result, the toner image, which is on each photosensitive drum 1 and is negative in polarity, is transferred onto the recording medium S which is in contact with the photosensitive drum 1.

The feeding-and-conveying portion 16 is the portion that feeds the recording medium S into the main assembly 100 and conveys it to the image forming portion. The feeder cassette 17 holds multiple recording mediums S. During an image forming operation, a feeding-and-conveying roller 18 (roughly semicylindrical roller) and a pair of registration rollers 19 are rotationally driven in synchronism with the progression of the image forming operation. More specifically, as the feeding-and-conveying roller 18 is rotated, the recording mediums S in the cassette 17 are fed into the main assembly 100 while being separated one by one. As the leading edge of the recording medium S comes into contact with the pair of registration rollers 19, the recording medium S is temporarily held up, being thereby rendered arcuate, and then, is released by the pair of registration rollers 19 in synchronism with the rotation of the conveyer belt 11 and the movement of the image writing start line of the recording medium S, to be conveyed to the transfer belt 11.

The fixing portion 20 is the portion for fixing the multiple toner images different in color to the recording medium S after the transfer of the toner images onto the recording medium S. The fixing portion 20 has a rotatable heat roller 21*a*, and a rotatable pressure roller 21*b* kept pressed upon the heat roller 21*a* to apply heat and pressure to the recording medium S.

More specifically, after the transfer of the toner images on the photosensitive drums 1, onto the recording medium S, the recording medium S is conveyed through the fixing portion 20. While the recording medium S is conveyed through the fixing portion 20, heat and pressure are applied by the heat roller 21*a*. As a result, the multiple toner images different in color are fixed to the surface of the recording medium S.

The image forming operation carried out by the above described image forming apparatus is as follows: First, the process cartridges 7 (7*a*, 7*b*, 7*c*, and 7*d*) are sequentially driven in synchronism with the printing timing. Thus, the photosensitive drums 1*a*, 1*b*, 1*c*, and 1*d* are sequentially driven in the counterclockwise direction, along with the scanner units 3 which correspond in position to the process cartridges 7, one for one. As the process cartridges 7 are driven, each charging means 2 uniformly charges the peripheral surfaces of the corresponding photosensitive drum 1. Each scanner unit 3 exposes the peripheral surface of the corresponding photosensitive drum 1 in response to video signals. As a result, an electrostatic latent image is formed on the peripheral surface of the photosensitive drum 1. The development roller 40 in each developing apparatus 4 forms a toner image on the peripheral surface of the corresponding photosensitive drum 1, by transferring the toner onto the multiple points of the electrostatic latent image, which are low in potential level (it develops electrostatic latent image).

As for the timing with which the recording medium S is delivered to the transfer belt 11, the rotation of the registration rollers 19 are started to convey the recording medium S to the transfer belt 11 in such a manner that the arrival of the leading edge of the toner image on the most upstream photosensitive drum 1 at the contact area between the photosensitive drum 1 and transfer belt 11 coincides with the arrival of the printing start point on the recording medium S at the contact area.

As the recording medium S is delivered to the transfer belt 11, the recording medium S is sandwiched by an electrostatic adhesion roller 22 and transfer belt 11, being thereby placed in contact with the outward surface of the transfer belt 11, in terms of the loop the belt 11 forms. Then, the voltage is applied between the transfer belt 11 and adhesion roller 22, whereby electric charge is induced in the recording medium S, which is dielectric, and the dielectric layer of the transfer belt 11. As a result, the recording medium S is electrostatically adhered to the outward surface of the transfer belt 11, making it thereby possible for the recording medium S to be conveyed up to the most downstream transfer point while remaining securely adhered to the transfer belt 11.

While the recording medium S is conveyed in the above described manner, the toner image on each of the photosensitive drum 1 is sequentially transferred onto the recording medium S by the electric field formed between the photosensitive drum 1 and transfer roller 12.

After the transfer of the four monochromatic toner images different in color onto the recording medium S, the recording medium S is separated from the transfer belt 11 with the utilization of the curvature of the driver roller 13, and is conveyed into the fixing portion 20, in which the toner images are thermally fixed to the recording medium S. Thereafter, the recording medium S is discharged from the apparatus main assembly 100 by a pair of discharge rollers 23 through a recording medium outlet 24, with the image bearing surface of the recording medium S facing downward.

(Structure of Process Cartridge)

Figure 2:
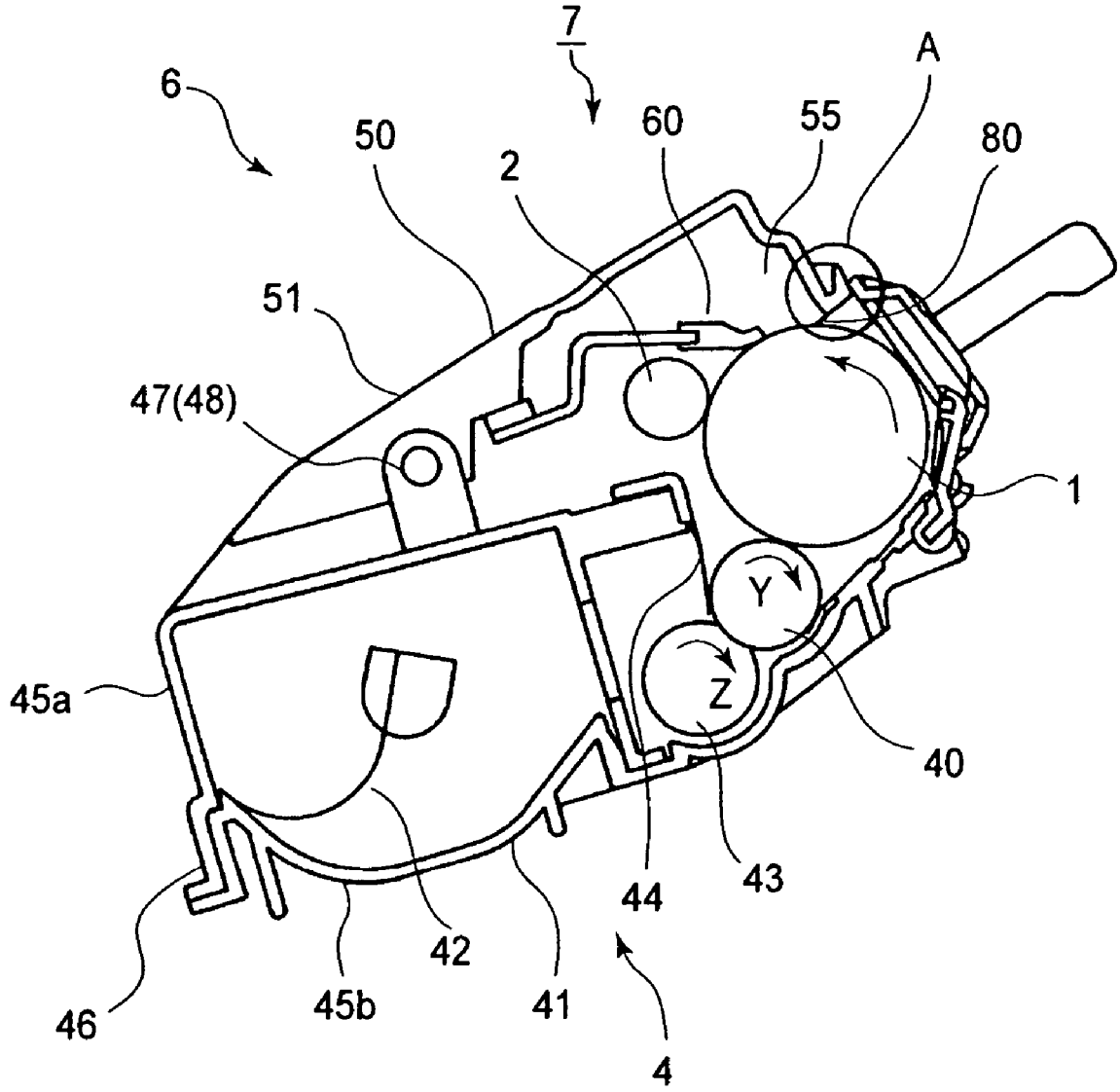
FIG. 2 is a schematic sectional view of the process cartridge in the preferred embodiment of the present invention.
Figure 3:
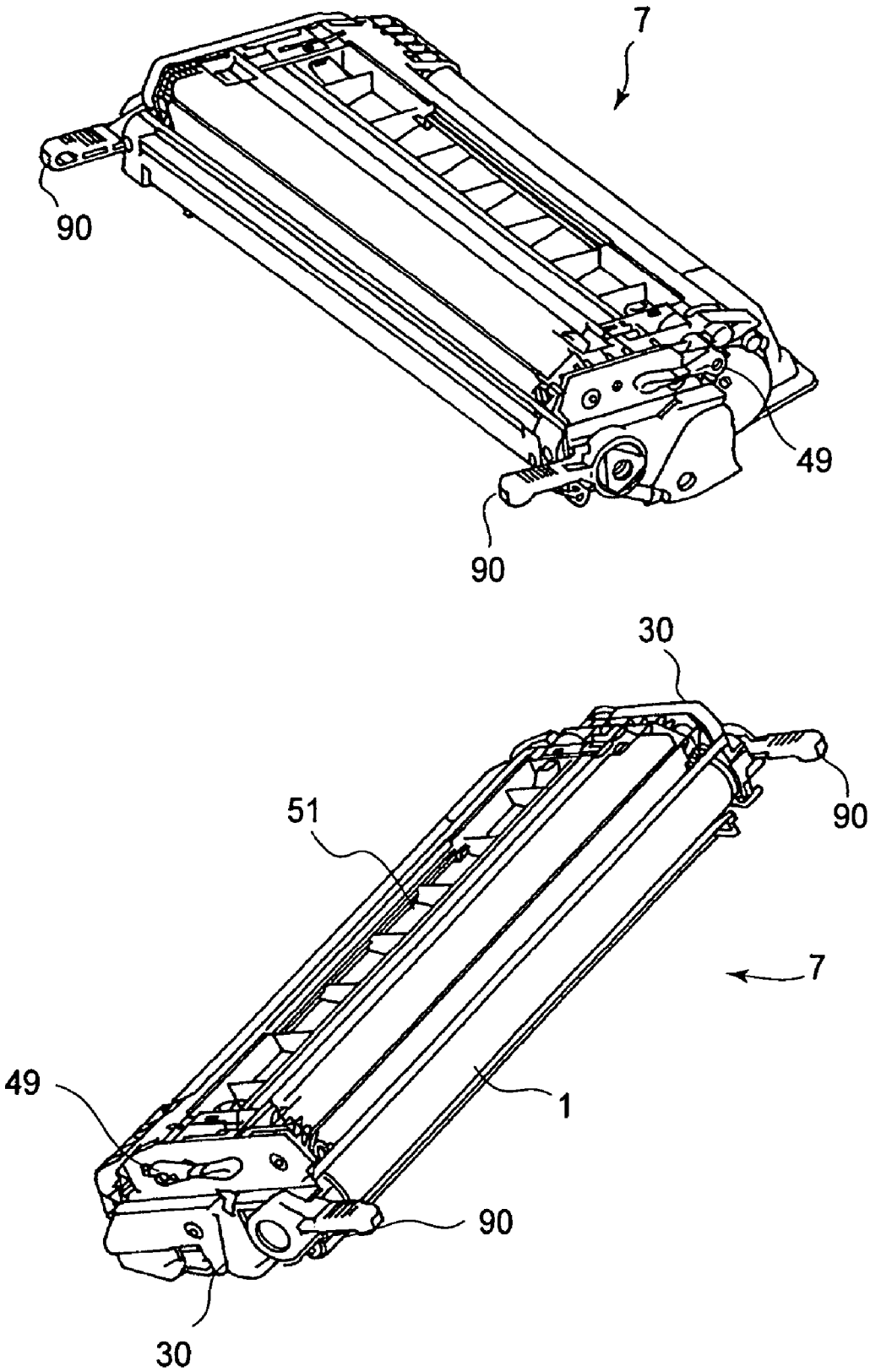
FIG. 3 is a schematic perspective view of the process cartridge in the preferred embodiment of the present invention.

Next, referring to FIGS. 2 and 3, the process cartridge in this embodiment will be described in detail. FIGS. 2 and 3 are sectional and perspective views, respectively, of the process cartridge 7 which stores developer. Incidentally, the process cartridges 7*a*, 7*b*, 7*c*, and 7*d* storing the developers of yellow, magenta, cyan, and black toners, respectively, are identical in structure.

Each process cartridge 7 is separable into a cleaner unit 50, and a development unit 4. The cleaner unit 50 has the photosensitive drum 1, charging means 2, and cleaning means 6 (cleaning apparatus 6), and the development unit 4 has the development roller 40 as the developing means for developing an electrostatic latent image on the photosensitive drum 1.

The cleaner unit 50 which also functions as a developer container has a frame 51 (container body), which hereinafter will be referred to as cleaner unit frame, and which stores at least toner. The photosensitive drum 1 is rotatably attached to the cleaner unit frame 51, with the interposition of a pair of bearings 31 (31*a* and 31*b*).

In the adjacencies of the peripheral surface of the photosensitive drum 1, the primary charging means 2, a cleaning blade 60 as a cleaning member, and a flexible sheet 80 are disposed. The primary charging means 2 uniformly charges the photosensitive layer of the photosensitive drum 1, which constitutes the peripheral layer of the photosensitive drum 1. The cleaning blade 60 removes the developer (residual toner) remaining on the peripheral surface of the photosensitive drum 1 after the image transfer.

After being removed from the peripheral surface of the photosensitive drum 1 by the cleaning blade 60, the residual toner (waste toner) is stored in a waste toner chamber 55 located in the rear portion of the cleaner unit frame 51.

The toner remaining on the photosensitive drum 1 moves past the contact area between the flexible sheet 80 and photosensitive drum 1 (drum contact area), and reaches the contact area between the photosensitive drum 1 and cleaning blade 60, in which the residual toner is removed from the photosensitive drum 1 by the cleaning blade 60. The flexible sheet 80 is disposed so that its state of contact with the photosensitive drum 1 satisfies the requirement necessary to prevent the residual toner on the photosensitive drum 1 from leaking out of the cleaner unit frame 51 after the removal of the residual toner from the photosensitive drum 1 by the cleaning blade 60.

The development unit 4 has a developer container 46, which has development unit frames 45*a* and 45*b*, and the development roller 40 which is a rotational member. To the development unit frames 45*a* and 45*b*, the development roller 40 is attached, being enabled to rotated in the direction indicated by an arrow mark Y in FIG. 2, with a minuscule gap retained between the development roller 40 and photosensitive drum 1.

The development unit frames 45*a* and 45*b* are joined (by ultrasonic welding or the like method) to form the developer container 46.

The development roller 40 is rotatably supported by the developer container 46, with the interposition of bearing members. In the adjacencies of the peripheral surface of the development roller 40, the toner supply roller 43, which rotates in the direction indicated by an arrow mark Z in FIG. 2, in contact with the development roller 40, and the development blade 44, are disposed. Further, in the developer container 46, the aforementioned toner conveyance mechanism 42 for conveying the toner in the developer container 46, to the toner supply roller 43 while stirring it, is disposed.

The development unit 4 is attached to the cleaner unit 50 so that the development unit 4 is suspended from the cleaner unit 50 in a manner to be pivotally movable relative to the cleaner unit 50. More specifically, the connective holes 47 and 48 with which the lengthwise end portions of the developer container 46 are provided one for one are aligned with the supportive holes with which the lengthwise end portions of the cleaner unit frame 51 are provided one for one. Then, a pair of pins 49 are inserted from the lengthwise end portions of the cleaner unit frame 51.

Further, the development unit 4 is kept pressured by pressure application springs so that the development roller 40, which is rotatable about the axial lines of the supportive holes, is kept placed in contact with the photosensitive drum 1. During a development operation, the toner in the developer container 41 is conveyed by the toner conveyance mechanism 42 to the toner supply roller 43. Thus, as the toner supply roller 43, which rotates in the direction indicated by the arrow mark Y in FIG. 2, and the development roller 40, which rotates in the direction indicated by the arrow mark Z in FIG. 2 rub against each other, the toner on the toner supply roller 43 is transferred onto the development roller 40, being thereby borne on the development roller 40.

As the development roller 40 rotates, the toner on the development roller 40 reaches the development blade 40, by which the toner on the development roller 40 is formed into a thin layer of toner with a preset thickness, while being given a preset amount of electric charge. As the development roller 40 further rotates, the thin layer of toner on the development roller 40 is conveyed to the development area, in which the photosensitive drum 1 and development roller 40 are very close to each other. In the development area, the toner on the development roller 40 is adhered to the electrostatic latent image on the photosensitive drum 1, by the development bias applied to the development roller 40 from an unshown electric power source; in other words, the toner develops the latent image. The toner remaining on the peripheral surface of the development roller 4, that is, the toner on the development roller 40, which did not contribute to the development of the latent image, is returned to the development container 41 by the rotation of the development roller 40, and then, is stripped from the development roller 40 in the aforementioned area, in which the toner supply roller 43 and development roller 40 rub against each other, to be recovered. The recovered toner is mixed with the toner in the developer container 41, by the stirring action of the toner conveyance mechanism 42.

[Method for Mounting Process Cartridge into Image Forming Apparatus Main Assembly and Method for Removing Process Cartridge from Image Forming Apparatus Main Assembly]

Figure 4:
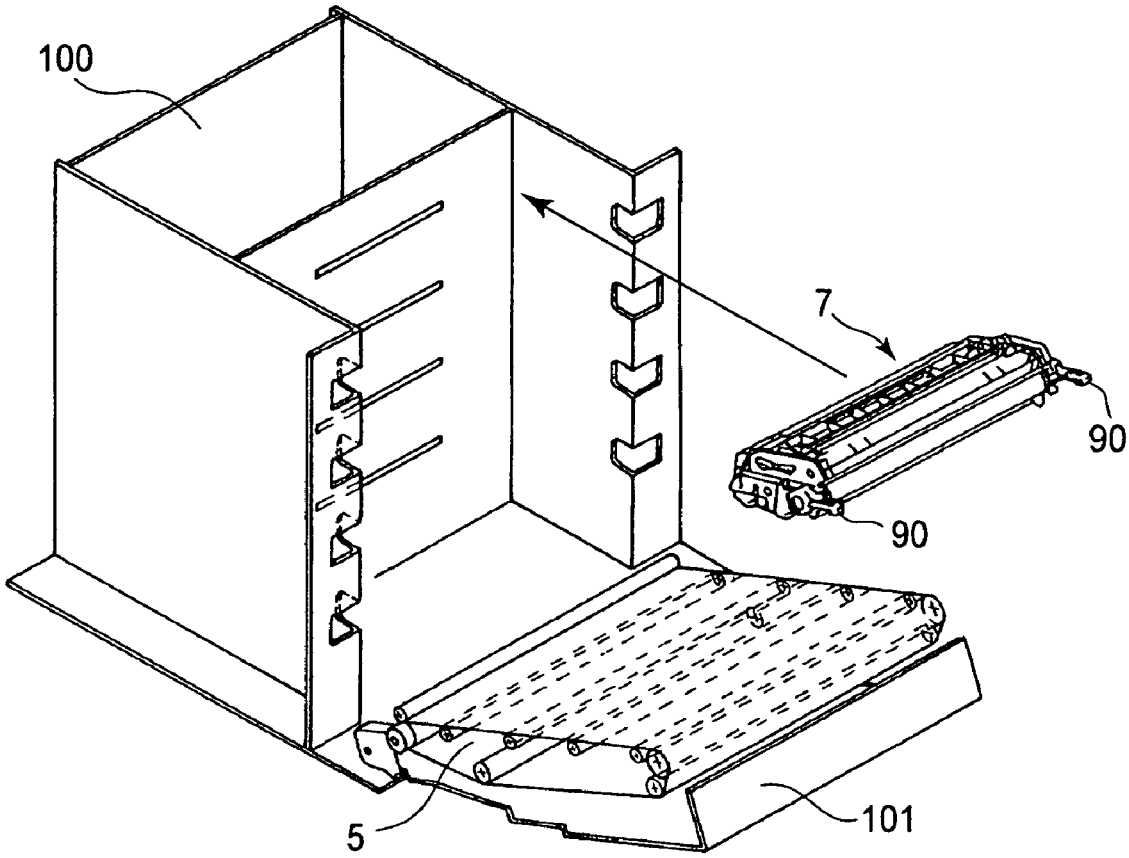
FIG. 4 is a schematic perspective view of the main assembly of the image forming apparatus, and one of the process cartridge, in the preferred embodiment of the present invention, showing how the process cartridge is mounted into the main assembly.

Next, referring to FIG. 4, the method for mounting the process cartridge 7 into the image forming apparatus main assembly 100 and the method for removing the process cartridge 7 from the image forming apparatus main assembly 100 will be described. As shown in FIG. 4, the image forming apparatus main assembly 100 is provided with a front door 101, which is rotatably attached to the apparatus main assembly 100. Behind the front door 101, the electrostatic transferring apparatus 5 is rotatably disposed. It is when the front door 101 and electrostatic transferring apparatus 5 are in the open position that each of the cartridges 7 is removably mountable in the image forming apparatus main assembly 100. Each cartridge 7 is provided with a pair of handgrips 90, which are located at the lengthwise ends of the cartridge 7, near the photosensitive drum supporting portions of the cartridge 7, one for one. When the cartridge 7 is mounted or removed, the cartridge 7 is to be positioned so that the handgrips 90 protrudes toward the front door 101.

The image forming apparatus main assembly 100 is provided with a pair of internal guide rails (unshown), and the cartridge 7 is provided with a pair of insert guides (unshown). The engagement of the insert guides of the process cartridge 7 with the guide rails of the image forming apparatus main assembly 100 makes it possible for the process cartridge 7 to be mounted into, or removed from, the image forming apparatus main assembly 100.

EMBODIMENT 1

Figure 5:
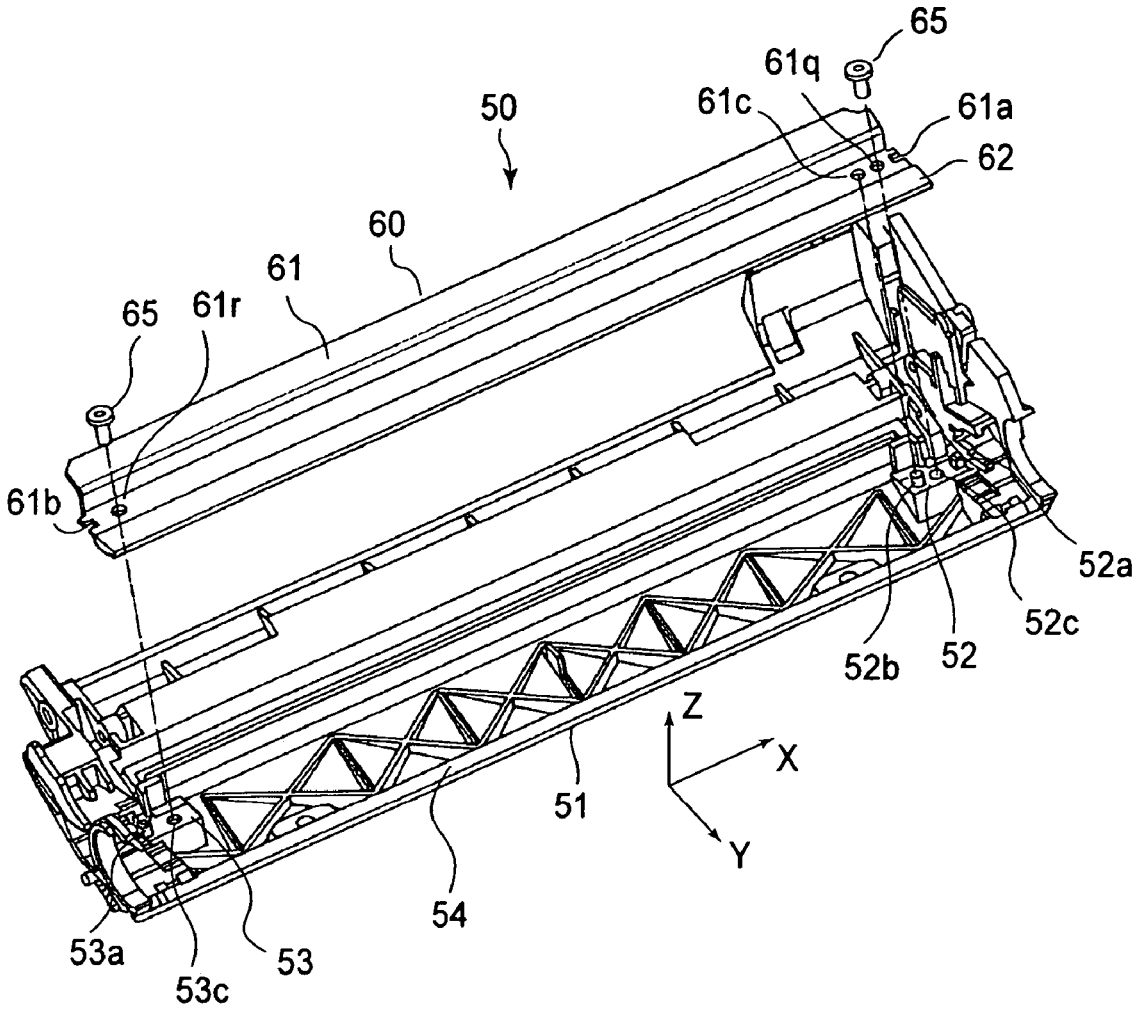
FIG. 5 is a partially exploded perspective view of the cleaning apparatus in the preferred embodiment of the present invention, showing how the cleaning member is attached to the frame of the cleaning apparatus.
Figure 6:
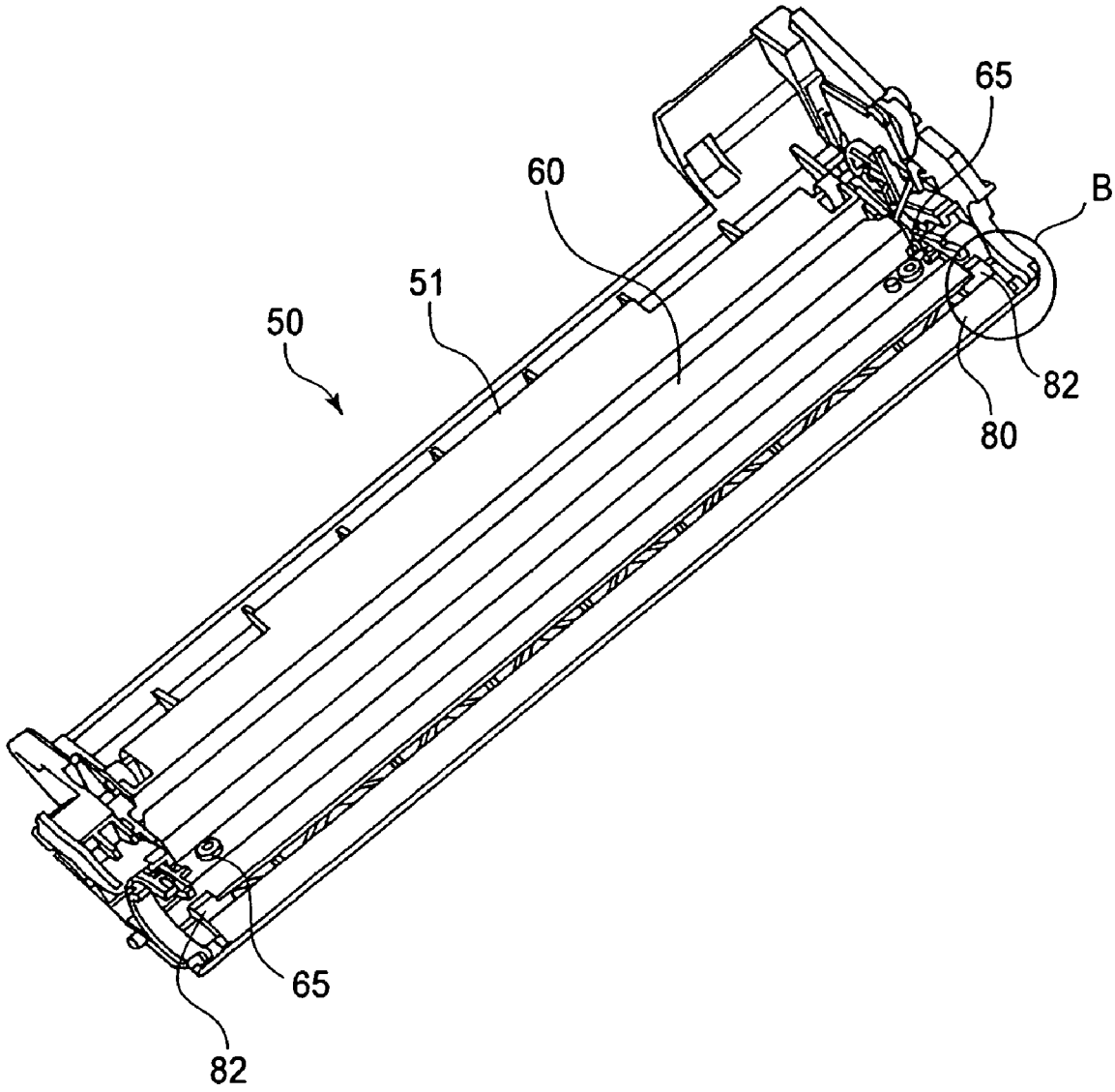
FIG. 6 is a schematic perspective view of the cleaning apparatus in the preferred embodiment of the present invention.
Figure 7:
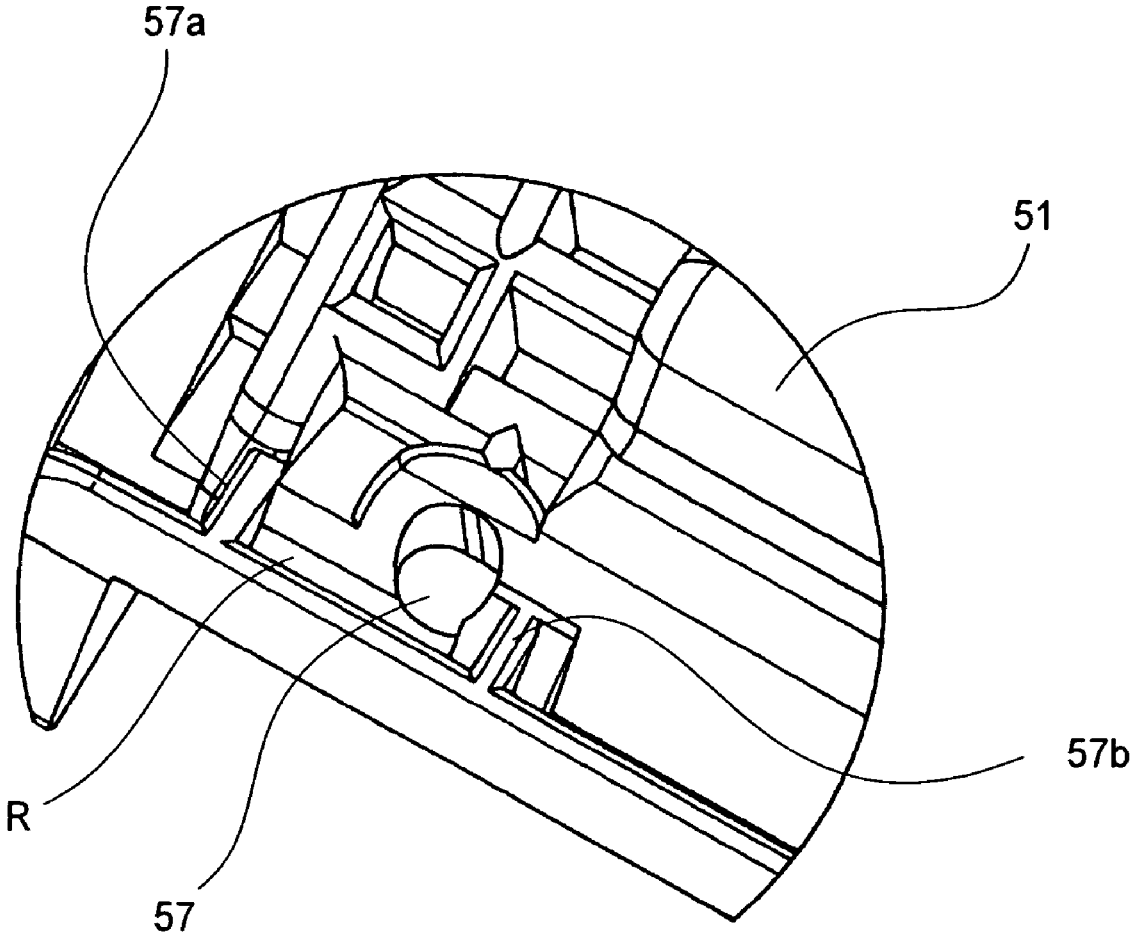
FIG. 7 is a schematic perspective view of the seal injection opening of the cleaner unit frame, and its adjacencies, in the preferred embodiment of the present invention.
Figure 8:
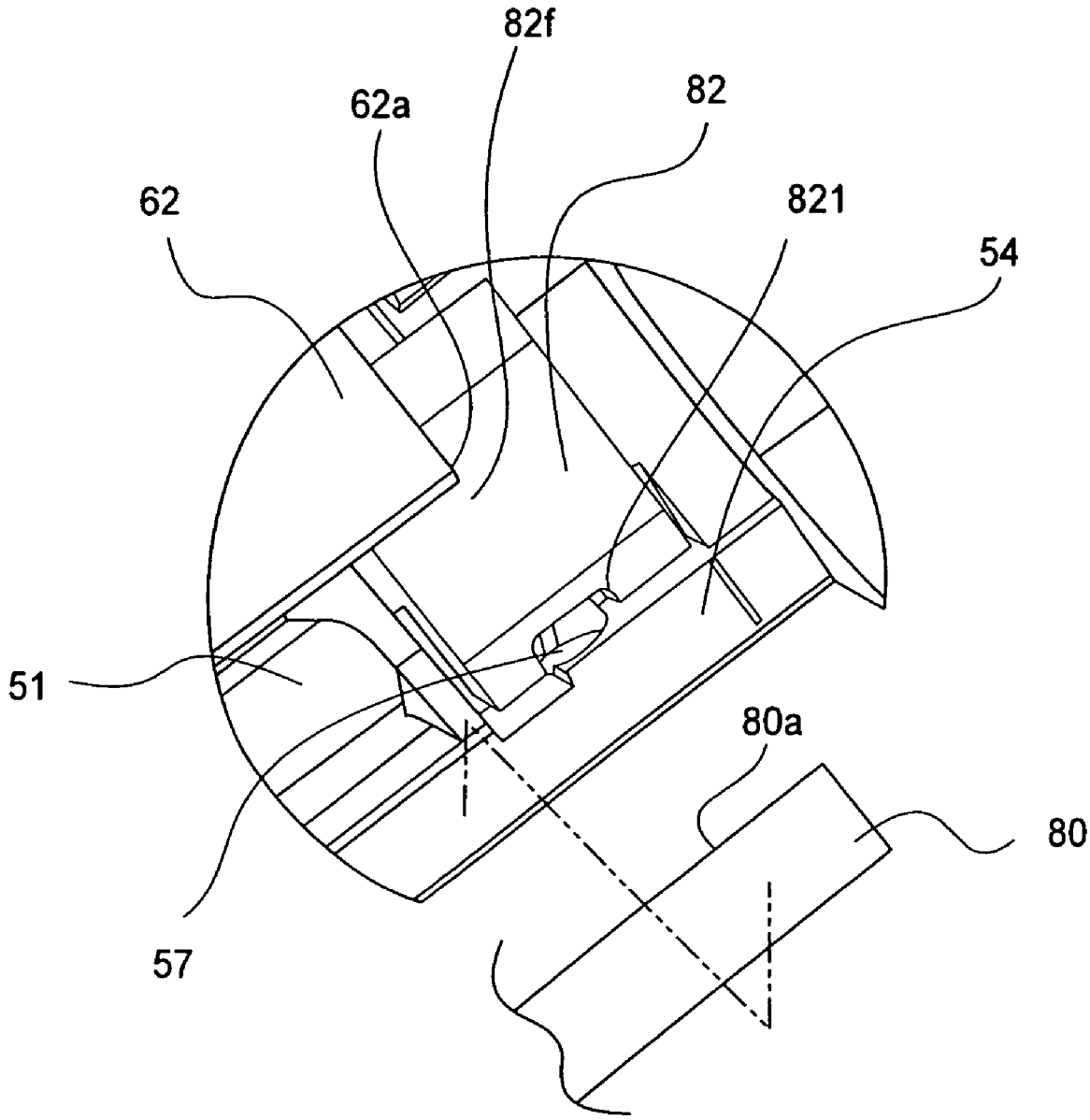
FIG. 8 is a schematic perspective view of one of the lengthwise end portions of the cleaner unit frame, and corresponding end seal, in the preferred embodiment of the present invention.
Figure 9:
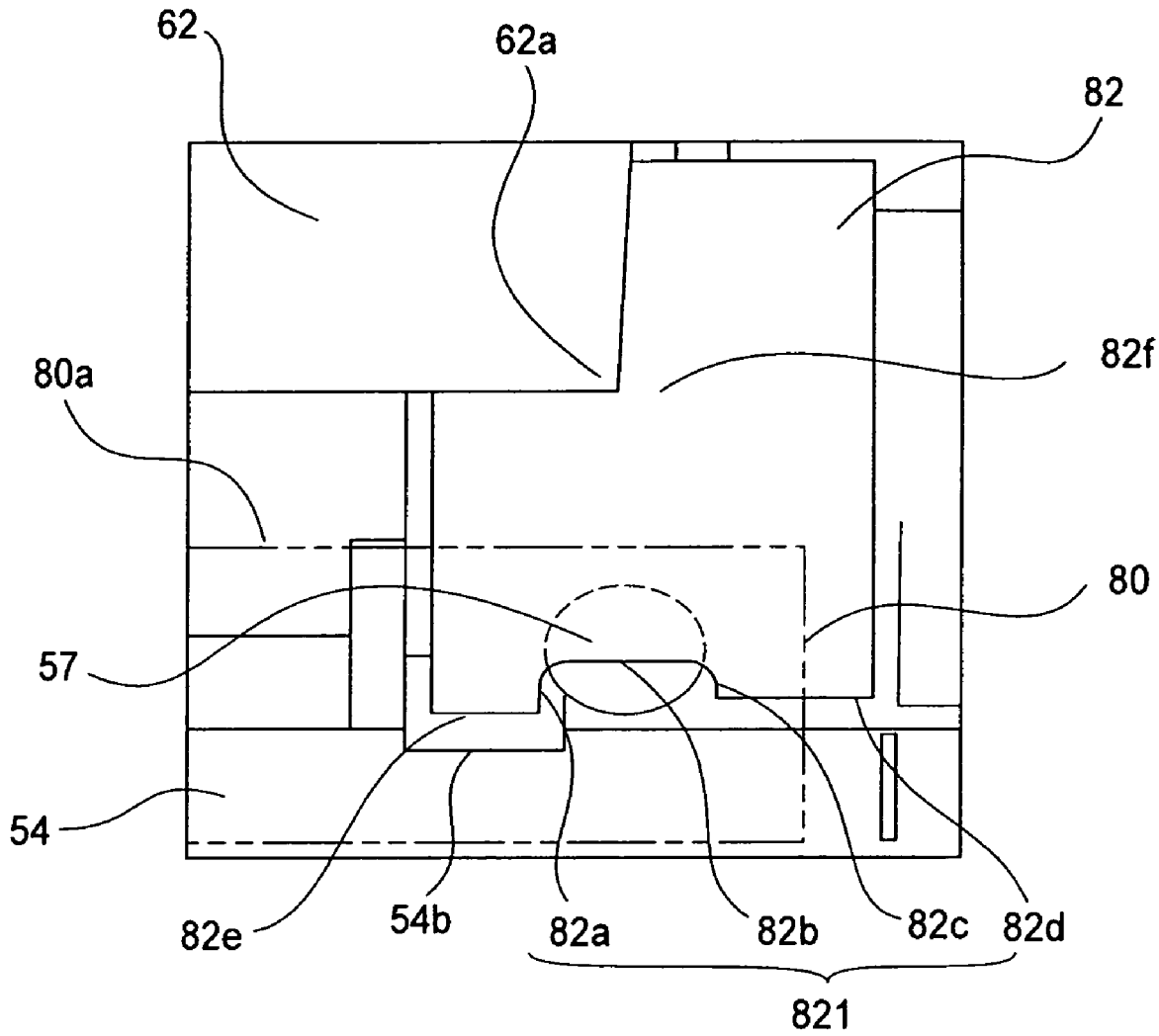
FIG. 9 is a schematic front view of one of the lengthwise end portions of the cleaner unit frame, and corresponding end seal, in the preferred embodiment of the present invention (Embodiment 1).
Figure 10:
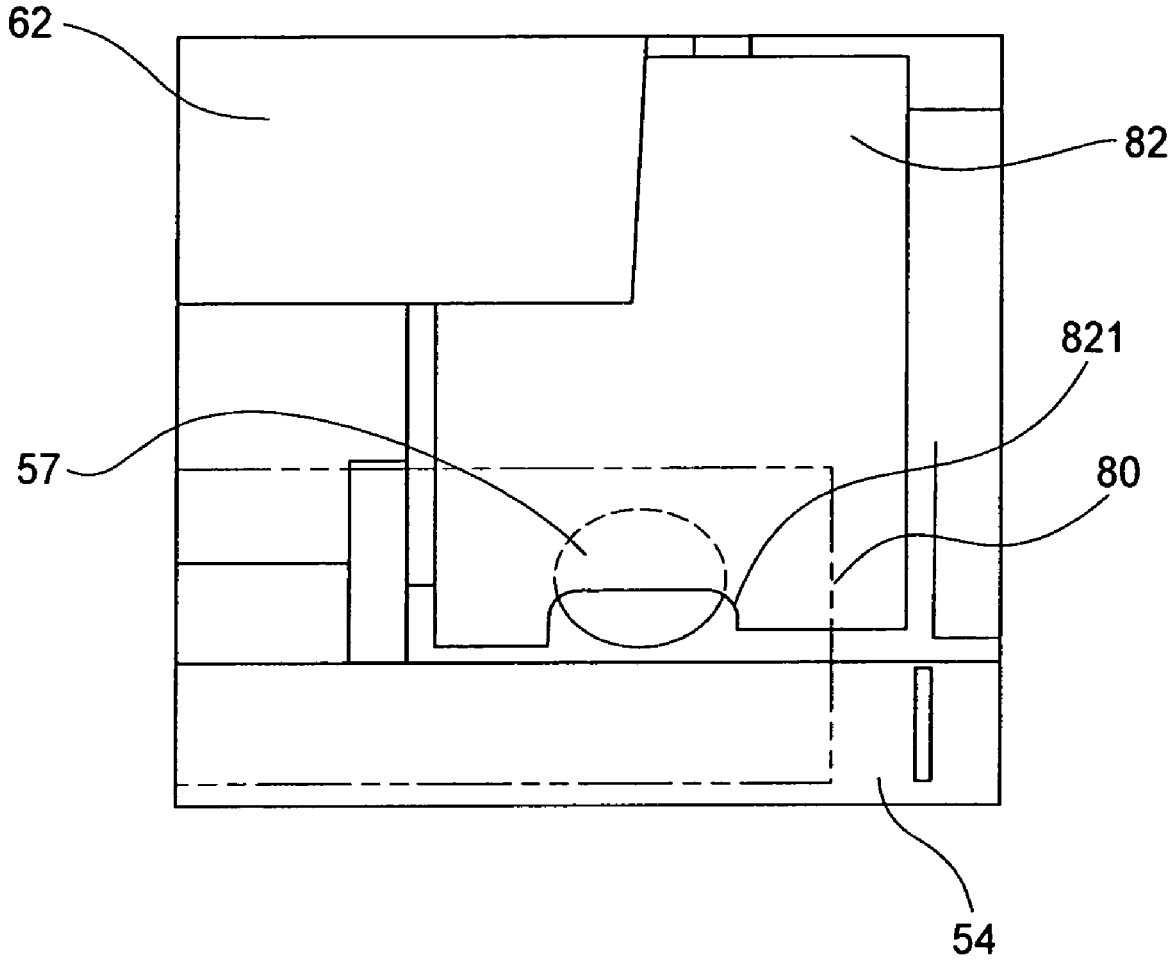
FIG. 10 is a schematic front view of one of the lengthwise end portions of the cleaner unit frame, and corresponding end seal, in the preferred embodiment of the present invention (another embodiment).
Figure 11:
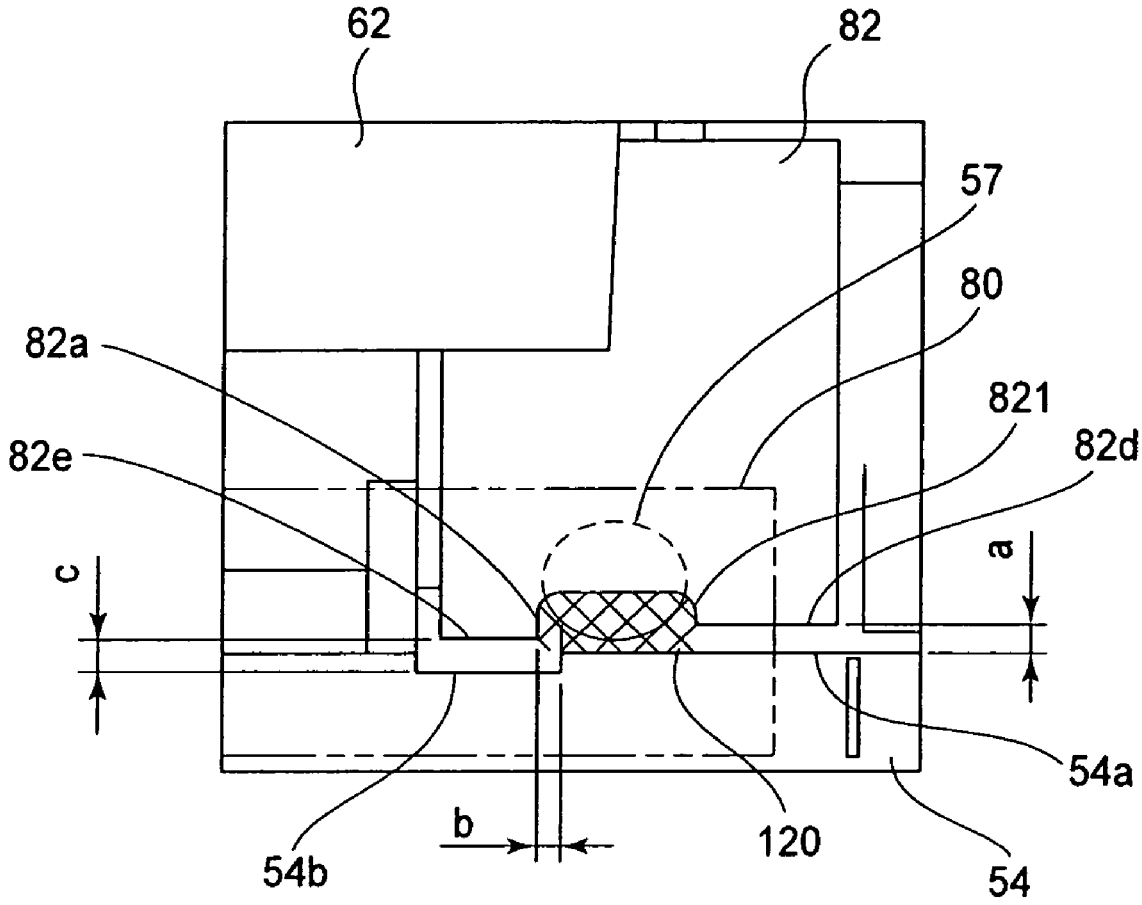
FIG. 11 is a schematic front view of one of the lengthwise end portions of the cleaner unit frame, corresponding end seal, and corresponding body of filler/sealer, in the preferred embodiment of the present invention.
Figure 12:
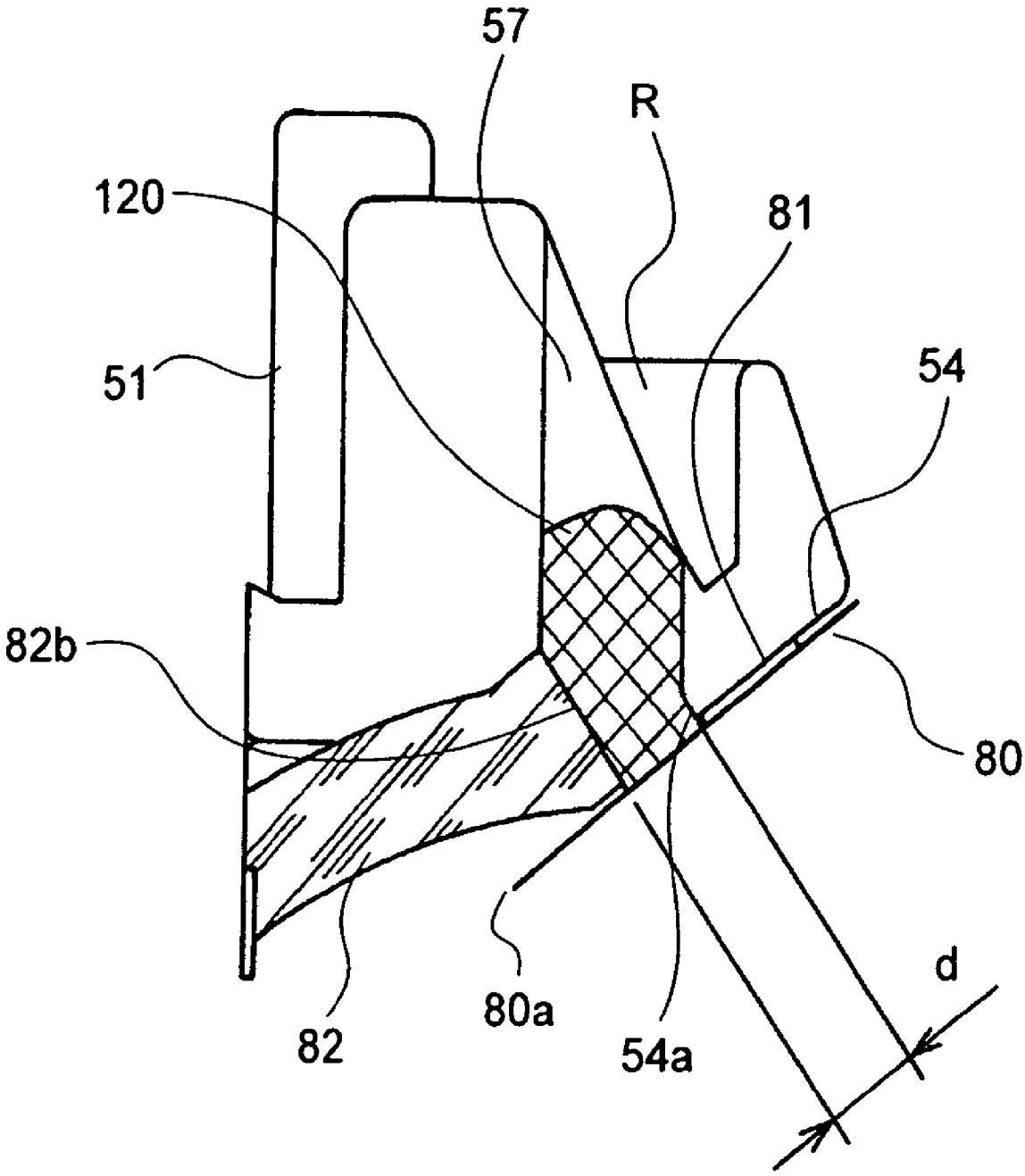
FIG. 12 is a schematic sectional view of one of the lengthwise end portions of the cleaner unit frame, corresponding end seal, and corresponding body of filler/sealer, in the preferred embodiment of the present invention.
Figure 13:
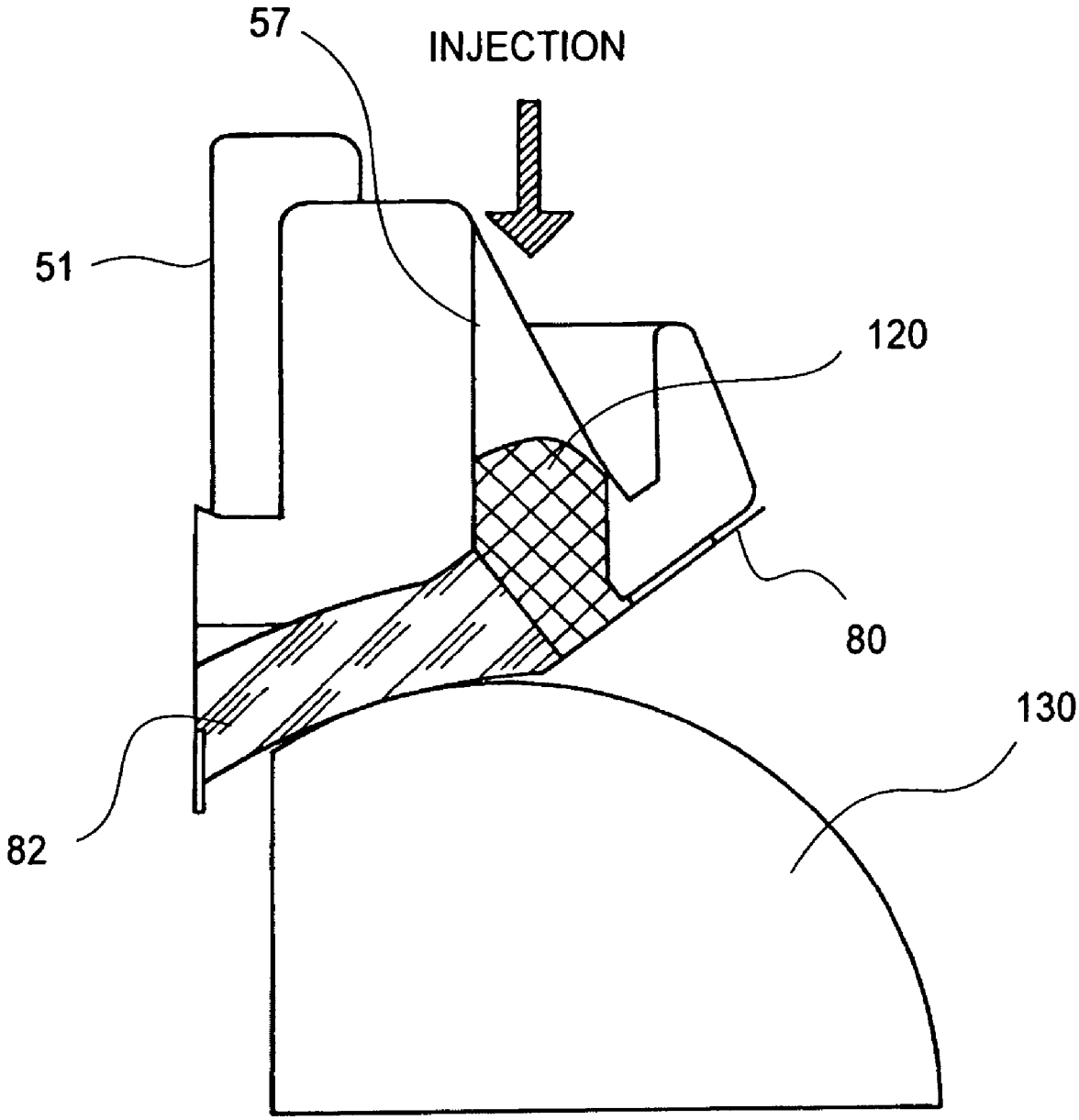
FIG. 13 is a schematic sectional view of the backup member, and its adjacencies, showing how the filler/sealer is injected, in the preferred embodiment of the present invention.
Figure 14:
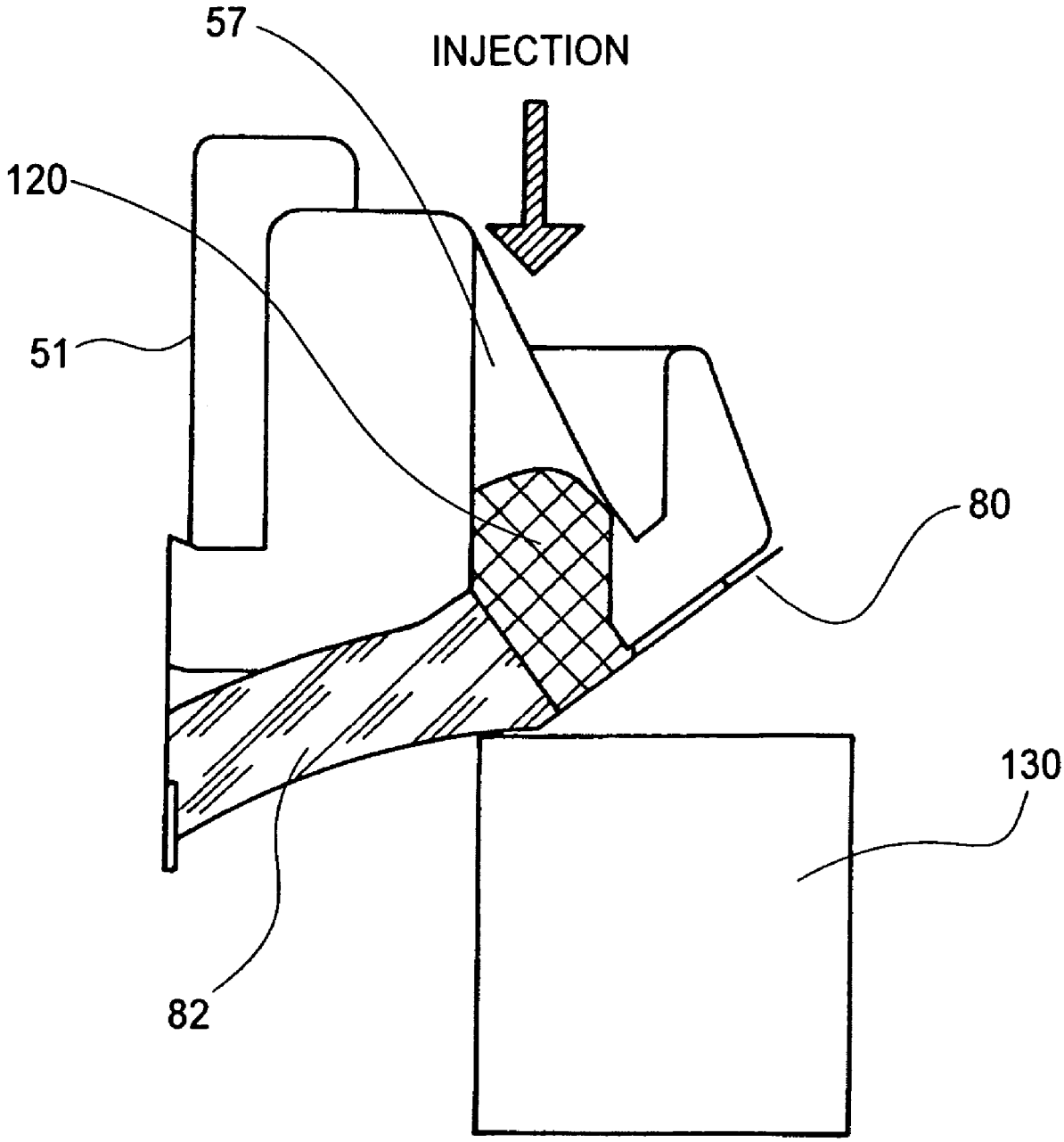
FIG. 14 is a schematic sectional view of the backup member, and its adjacencies, showing how the filler/sealer is injected, in another preferred embodiment of the present invention.

Next, referring to FIGS. 2, and 5-14, one of the preferred embodiments of the present invention will be described. FIG. 5 is a schematic perspective view of the cleaning apparatus, showing how the cleaning member is attached to the cleaner unit frame 51. FIG. 6 is a schematic perspective view of the cleaner unit 50. FIG. 7 is a schematic perspective view of the filler/sealer inlet of the cleaner unit frame 51. FIG. 8 is a schematic perspective view of one of the lengthwise end portions of the cleaner unit frame 51, and the corresponding end seal 82. FIG. 9 is a schematic front view of one of the lengthwise end portions of the cleaner unit frame 51, and the corresponding end seal 82. FIG. 10 is a schematic front view of one of the lengthwise end portions of the cleaner unit frame 51, and corresponding end seal 82. FIG. 11 is a schematic front view of one of the lengthwise end portions of the cleaner unit frame 51, the corresponding end seal 82, and the corresponding body of filler/sealer 120. These drawings, that is, FIGS. 8-11, correspond to a portion B in FIG. 6. FIG. 12 is a schematic sectional view of one of the lengthwise end portions of the cleaner unit frame 51, the corresponding end seal 82, and the corresponding body of filler/sealer 120. FIG. 13 is a schematic sectional view of the backup member 130, and its adjacencies, showing how the filler/sealer is injected. FIG. 14 is a schematic sectional view of the backup member 130, and its adjacencies, in another embodiment of the present invention, showing how the filler/sealer is injected. These drawings, that is, FIGS. 12-14, correspond to a portion A in FIG. 2.

First, the essential structure of the cleaner unit 51 will be described.

Referring to FIG. 6, the cleaner unit 50 has the cleaner unit frame 51, the cleaning blade 60, the pair of end seals 82 as sealing members, the flexible sheet 80 (which hereafter will be referred to as scooping sheet). The pair of end seals 82 are located at the lengthwise ends of the photosensitive drum 1, one for one, and prevent toner from leaking from the cleaner unit frame 51. The scooping sheet 80 guides the developer removed from the photosensitive drum 1 by the cleaning blade 60, into the cleaner unit frame 51.

Next, the sequence for assembling the cleaner unit 50 will be described.

Referring to FIG. 5, first, a metallic base plate 61 of the cleaning blade 60 is fastened to the cleaner unit frame 51, as the casing of the cleaner unit 50, with use of self-tapping screws 65. The cleaning blade mounts 52 and 53 of the cleaner unit frame 51, that is, the portions of the cleaner unit frame 51, to which the metallic base plate 61 is to be fastened, are located at the lengthwise ends of the cleaner unit frame 51. The self-tapping screws 65 are put through the holes 61*q* and 61*r* of the metallic base plate 61, and are screwed into the starter holes 52*c* and 53*c* of the cleaning blade mounts 52 and 53, respectively. Before the attachment of the cleaning blade 60, a pair of foamed elastic seals (unshown) for sealing the gap between an elastic blade 62 and the cleaner unit frame 51 are pasted to the lengthwise ends of the cleaner unit frame 51, one for one.

Referring again to FIG. 5, as for the positioning of the cleaning blade 60 in terms of the X direction (direction parallel to lengthwise direction of frame 51), the cleaning blade 60 is accurately positioned by engaging the cleaning blade positioning boss 52*b* of the blade mount 52, into the elongated hole 61*c* of the metallic base plate 61. In terms of the Y direction (direction parallel to width direction of frame 51), the cleaning blade 60 is accurately positioned by engaging the square bosses 52*a* and 53*a* of the blade mount 52 and 53, into the notches 61*a* and 61*b* of the metallic base plate 61, respectively. In terms of the Z direction (direction parallel to height direction of frame 51), the cleaning blade 60 is accurately positioned by the top surfaces of the blade mount 52 and 53; the position of the cleaning blade 60 is fixed by the heights of the blade mounts 52 and 53. In other words, the manner in which the cleaning blade 60 is placed in contact with the photosensitive drum 1 is determined by the above described positioning of the cleaning blade 60.

After the attachment of the cleaning blade 60, the pair of end seal 82 as sealing members are pasted to the cleaner unit frame 51.

Each of the end seals 82 is disposed so that the corner 62*a* of the elastic blade 62 perfectly fits into the corner notch 82*f* of the end seal 82 (FIGS. 8 and 9). Then, the end seal 82 is adhered to the cleaner unit frame 51 with the use of a piece of two-sided adhesive tape (unshown) integrated with the end seal 82 (end seal 82 on the other side is similarly adhered to cleaner unit frame 51).

After the pasting of the end seals 82, the scooping sheet 80 is pasted.

More specifically, first, a piece of two-sided adhesive tape 81 is pasted to the surface of the scooping sheet mount 54 of the cleaner unit frame 51. Then, the scooping sheet 80 is pressed onto the two-sided adhesive tape 81, being thereby pasted thereto (FIG. 12). As a result, the scooping sheet 80 seals a gap d. The two-sided adhesive tape 81 in this embodiment is 1.5-2.5 mm in width. Further, in this embodiment, the cleaner unit frame 51 to which the end seals 82, scooping sheet 80, and cleaning blade 60 are attached is a single-piece frame. However, the cleaner unit frame 51 does not need to be made up of a single component. For example, the portion of the cleaner unit frame 51, to which the end seals 82 are to be attached, the portion of the cleaner unit frame 51, to which the scooping frame 80 is to be attached, and the portion of the cleaner unit frame 51, to which the cleaning blade 60 is to be attached, may be separately manufactured. In this embodiment, the frame of the cleaner unit 50 is referred to as cleaner unit frame 51 regardless of whether it is a single-piece component, or made up of multiple components.

Next, the filler/sealer 120, which functions not only as adhesive, but also, as sealer, is injected into the gaps among the end seals 82, cleaner unit frame 51, and scooping sheet 80, in order to fill the gaps (FIG. 12). With this injection of the filler/sealer 120, the gap d, which results between the surface 54*a* of the scooping sheet mount 54 of the cleaner unit frame 51 and the end seal 82, from the errors in the shape of the end seal 82 and/or the errors in the processes of pasting the end seal 82 and scooping sheet 80, can be sealed. In this embodiment, a thermoplastic elastomer is employed as the filler/sealer 120. However, fast-setting silicone adhesive/sealer, or bond curable with ultraviolet rays, may be used as the filler/sealer 120.

Next, the areas into which the filler/sealer 120 is to be injected will be described.

Referring to FIGS. 8 and 9, each end seal 82 is provided with a recess 821, which has a surface 82*a*, a surface 82*b*, and a surface 82*c*. Next, referring to FIG. 11, the filler/sealer 120 is injected into the recess 821, and the gap d between the recess 821 and the predetermined portion of the surface 54*a* of the scooping sheet mount 54. The gap d is covered with the scooping sheet 80. In other words, the space surrounded by the surfaces of the recess 821, the surface 54*a*, and the scooping sheet 80 is the space into which the filler/sealer 120 is to be injected. Incidentally, as the photosensitive drum 1 is attached to the cleaner unit frame 51, the gap d is positioned on the opposite side of the scooping sheet 80 from the photosensitive drum 1. Further, the surface 54*a* of the scooping sheet mount 54 is roughly perpendicular to the scooping sheet mounting surface of the scooping sheet mount 54.

In this embodiment, the scooping sheet mount 54 is only 3 mm or so in width. Therefore, in consideration of the errors in the pasting of the two-sided adhesive tape 81 or the like, the surface of the scooping sheet mount 54, to which the scooping sheet 81 is to be pasted, is desired to extend from one lengthwise end of the mount 54 to the other. Therefore, the recess 54*b*, with which the scooping sheet mount 54 is to be provided, is rendered as small as possible, and the gap d is formed between the surface 54*a* (flat portion of surface 54*a*) and the recess 821 of the end seal 82.

Also in this embodiment, the recess 821 is positioned between the functional edge 80*a* of the scooping sheet 80 and the surface 54*a* (recess 821 is sandwiched between part of scooping sheet 80 and cleaner unit frame 51) to utilize the adhesiveness of the filler/sealer 120 to increase the amount of the force required to separate the scooping sheet 80 from its mount 54. Therefore, the scooping sheet 80 is prevented from being separated from its mount 54 by the resiliency of the end seal 82. In other words, the employment of the above described structural arrangement in this embodiment makes it possible to increase the amount of the force required to separate the scooping sheet 80 from its mount 54, making it thereby possible to reduce in width the two-sided adhesive tape which is adhered to the scooping sheet mount 54.

Incidentally, the scooping sheet mount 54 does not need to be provided with the recess 54*b*. In other words, the surface 54*a* of the scooping sheet mount 54 may be left flat in its entirety, as shown in FIG. 10.

Also in this embodiment, a gap a is provided between the surface 82*d* of the end seal 82 and the surface 54*a* of the scooping sheet mount 54, on both sides of the recess 821. Further, a gap b is provided between the surface 82*a* of the end seal 82 and one of the lateral surfaces of the recess 54*b* of the scooping sheet mount 54, and a gap c is provided between the surface 82*e* of the end seal 82 and the bottom surface of the recess 54*b* of the scooping sheet mount 54. These gaps a, b, and c are provided as buffer gaps (FIG. 11) for the filler/sealer 12. The provision of these buffer gaps makes it possible to relax the requirement regarding the amount by which the filler/sealer 120 is to be filled, improving thereby the cleaner unit 50 in terms of assembly efficiency. It also makes it possible to prevent gaps from reoccurring between the cleaner unit frame 51 and end seals 82, and also, to prevent the filler/sealer 120 from oozing along the edges of the scooping sheet 80.

Further, the cleaner unit frame 51 is provided with a through hole 57, which also functions as the buffer space. Referring to FIG. 7, the cleaner unit frame 51 is also provided with a pair of ribs 57*a* and 57*b*, which are located on both sides of the through hole 57. The employment of this structural arrangement makes it possible to utilize the area R sandwiched by the ribs 57*a* and 57, as another buffer space (reservoir).

In this embodiment, the through hole 57 as the filler/sealer injection hole is elongated in cross section. However, it is unnecessary for the through hole 57 to be limited in shape. Incidentally, the through hole 57 is connected to the gap d. Further, the through hole 57 is on the opposite side of the gap d from the scooping sheet 80.

Next, the method for injecting the filler/sealer 120 will be described.

The filler/sealer 120 is injected from the top side of the cleaner unit frame 51 (provided that cleaner unit frame 51 is in the same attitude as the attitude in which it is when cartridge is in image forming apparatus main assembly 100), through the through hole 57. Referring to FIG. 13, first, a pair of backup members 130, which are roughly the same in diameter, are placed in the cleaner unit frame 51 so that the backup member 130 match in position the pair of end seals 82, one for one. More specifically, the backup members 130 are placed in roughly the same positions as the positions in which the lengthwise ends of the photosensitive drum 1 would be if the photosensitive drum 1 were mounted in the process cartridge 7. Then, the filler/sealer 120 is to be injected from above, in the direction roughly perpendicular to the scooping sheet attachment surface of the scooping sheet mount 54, with the end seals 82 kept compressed. In other words, the filler/sealer 120 is to be injected through the through hole 57 with the scooping sheet 80 positioned below the gap d.

During the above described step, each end seal 82, which is 2.5-4.5 mm in thickness before the compression, is compressed so that its thickness reduces to 1.5-2.5 mm.

Incidentally, it is not necessary for the backup member 130 to be circular in cross section. That is, the backup member 130 may be polygonal in cross section. In such a case, the backup member 130 is to be positioned so that one of its corners is placed between the recess 821 of the end seal 80 and the functional edge 80*a* of the scooping sheet 80. However, giving the backup member 130 the circular cross section can reduce the amount of load to which the scooping sheet 80 and end seals 82 are subjected.

Next, the photosensitive drum 1 is to be attached to the cleaner unit frame 51 so that the lengthwise end portions of the photosensitive drum 1 are placed in contact with the corresponding end seals 82. During this step, a part of the scooping sheet 80 is between each end seal 82 and photosensitive drum 1 (FIGS. 9 and 13).

In this embodiment, the backup members 130 are employed to ensure that the filler/sealer 120 is prevented from adhering to the photosensitive drum 1. However, it is permissible to use the photosensitive drum 1 itself as the backup members. In such a case, the step in which the backup members 30 are employed is unnecessary. In other words, using the photosensitive drum 1 itself as the backup members 30 can reduce the number of steps in the cleaner unit 50 manufacturing process.

According to this embodiment, after being injected through the through hole 57, the filler/sealer 120 is filled into the recess 821 of the end seal 82, and the portion of the gap between the recess 821 and the portion of the surface 54*a* of the cleaner unit frame 51, which faces the recess 821. In other words, the filler/sealer 120 is regulated in terms of where it flows. Therefore, it is possible to prevent the filler/sealer 120 from oozing beyond the edges of the end seals 82 and scooping sheet 80.

Further, the backup members 130 are placed in contact with the end seals 82, one for one, when injecting the filler/sealer 120. Moreover, the buffer spaces and the like are provided in the adjacencies of the inlet side of the through hole 57, in terms of the height direction of the through hole 57, in addition to the gap between the recess 821 and surface 54*a*. Therefore, even if the amount by which the filler/sealer 120 is injected is substantial, the injected filler/sealer 120 remains in the gap between the recess 821 and surface 54*a*. Therefore, the injected filler/sealer 120 does not lift the scooping sheet 80, ensuring that the gaps between the cleaner unit frame 51 and end seals 82 remain completely sealed.

As described above, according to this embodiment, the gaps between the cleaner unit frame 51 and end seals 82 can be completely sealed, without strictly controlling the amount by which the filler/sealer 120 is injected. Further, it is possible to prevent the filler/sealer 120 from oozing beyond the edges of the end seals 82 and scooping sheet 80.

Also in the above described embodiment, the recess 821 is positioned between the functional edge of the scooping sheet 80, and the portion of the surface (surface 54*a*) of the cleaner unit frame 51, which directly faces the recess 821. This arrangement utilizes the adhesiveness of the filler/sealer 120. In other words, according to this embodiment, the adhesiveness of the filler/sealer 120 is utilized to increase the amount of force necessary to separate the scooping sheet 80 from the scooping sheet mount 54, preventing thereby the scooping sheet 80 from being separated from the mount 54 by the resiliency of the end seals 82. Therefore, it is possible to reduce in width the two-sided adhesive tape used for pasting the scooping sheet 80 to the cleaner unit frame 51. In other words, according to this embodiment, it is possible to prevent the developer from leaking, without strictly controlling the amount by which the filler is injected, and also, it is possible to prevent the filler from oozing out.

Incidentally, the application of the present invention is not limited to the cleaner unit; the present invention is also applicable to the development unit.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 136318/2005 and 113697/2006 filed May 9, 2005 and Apr. 17, 2006, respectively, which are hereby incorporated by reference.

What is claimed is:

1. A developer container for an image forming apparatus, said developer container comprising:

a rotatable member;

a container body for containing a developer;

a sealing member, provided in said container body, for preventing leakage of the developer out of said container body;

a sheet, provided in said container body, for contacting said rotatable member to guide the developer into said container body;

a gap provided between said container body and said sealing member and covered by said sheet;

a communication hole provided in said container body in fluid communication with said gap; and packing material filled in said gap through said communication hole for preventing leakage of the developer through said gap.

2. A developer container according to claim 1, wherein said communication hole is disposed across said gap from said sheet.

3. A developer container according to claim 1 or 2 , further comprising a reservoir for receiving the packing material leaked through said communication hole.

4. A developer container according to claim 1 or 2, wherein the packing material is injected through said communication hole with said sheet disposed below said gap.

5. A process cartridge detachably mountable to a main assembly of an image forming apparatus, said process cartridge comprising:

an image bearing member;

a cleaning member for removing a developer deposited on said image bearing member;

a container body for containing the developer removed by said cleaning member;

a sealing member, provided in said container body, for preventing the developer from leaking out of said container body;

a sheet, provided in said container body and for contacting said image bearing member to guide the developer removed by said cleaning member into said container body;

a gap provided between said container body and said sealing member and covered by said sheet;

a communication hole provided in said container body in fluid communication with said gap; and packing material filled in said gap through said communication hole for preventing leakage of the developer through said gap out of said container body.

6. A process cartridge according to claim 5, wherein said communication hole is disposed across said gap from said image bearing member.

7. A process cartridge according to claim 5 or 6, further comprising a reservoir for receiving the packing material leaked through said communication hole.

8. A developer container according to claim 5 or 6, wherein the packing material is injected through said communication hole with said sheet disposed below said gap.

9. An image forming apparatus for forming an image on a recording material, said apparatus comprising said detachably mountable process cartridge as defined in claim 5 or 6.

10. A manufacturing method for a developer container for use with an image forming apparatus, comprising:

i) a container body preparing step for preparing a container body for containing a developer, said container body having a communication hole;

ii) a sealing member mounting step of mounting a sealing member on said container body so as to provide a gap between said container body and itself, said gap being in fluid communication with said communication hole;

(iii) a sheet mounting step of mounting a sheet on said container body so as to cover said gap; and iv) a packing material injecting step of injecting packing material into said gap through said communication hole.

11. A method according to claim 10, further comprising a back-up member contacting step of contacting a back-up member to said sheet between said sheet mounting step and said packing material injecting step.

12. A method according to claim 10 or 11, wherein in said packing material injecting step, said communication hole is disposed across said gap from said sheet.

13. A method according to claim 10 or 11, wherein the packing material is injected through said communication hole with said sheet disposed below said gap.

* * * * *